US005416989A

United States Patent [19]

Preston

[11] Patent Number: 5,416,989

[45] Date of Patent: May 23, 1995

[54] SHOE WITH A SHANK HAVING A CUSHION THEREIN

[75] Inventor: John C. Preston, Manchester, Mo.

[73] Assignee: Brown Group, Inc., St. Louis, Mo.

[21] Appl. No.: 155,691

[22] Filed: Nov. 22, 1993

Related U.S. Application Data

[63] Continuation-in-part of Ser. No. 38,226, Mar. 29, 1993, abandoned.

[51] Int. Cl.[6] ..... A43B 23/00

[52] U.S. Cl. ..... 36/108; 36/76 R; 36/35 R

[58] Field of Search ..... 36/107, 108, 76 R, 76 C, 36/76 HH, 82, 72 R, 72 A, 73, 75 R, 25 R, 30 R, 34 R, 35 R, 37, 88, 91, 92, 103, 31, 28

[56] References Cited

U.S. PATENT DOCUMENTS

| | | | |
|---|---|---|---|
| 1,602,793 | 10/1926 | Block | 36/76 R |
| 1,711,788 | 5/1929 | Incutti | 36/76 R |
| 1,717,122 | 6/1929 | Schaff | 36/76 R |
| 1,801,532 | 4/1931 | Schaff | 36/76 R |
| 2,785,480 | 3/1957 | Maccarone | 36/76 R |
| 2,912,772 | 11/1959 | Harrison | 36/76 R |
| 3,091,872 | 6/1963 | Baumann et al. | 36/76 R |
| 4,794,707 | 1/1989 | Franklin et al. | 36/30 R |
| 4,835,884 | 6/1989 | Bianchini et al. | 36/108 |
| 5,134,791 | 8/1992 | Gregory | 36/76 R |
| 5,172,494 | 12/1992 | Davidson | 36/35 R |

FOREIGN PATENT DOCUMENTS

| | | | |
|---|---|---|---|
| 991425 | 5/1965 | United Kingdom | 36/108 |

*Primary Examiner*—Paul T. Sewell
*Assistant Examiner*—Thomas P. Hilliard
*Attorney, Agent, or Firm*—Polster, Lieder, Woodruff & Lucchesi

[57] ABSTRACT

A shoe construction having an upper formed with a toe cap at one end and a heel receiving surface at the opposite end, a molded outsole and shank attached to the upper with a heel connecting the shank into the upper at the heel receiving surface, a single attachment means securing the connection, an aperture in the heel receiving surface and matching aperture in the shank so that a cushion carried internally of the upper is located in the matching apertures to be visible from the exterior of the upper at the heel as an identification of the shoe construction.

12 Claims, 3 Drawing Sheets

SHOE WITH A SHANK HAVING A CUSHION THEREIN

This application is related to, contains subject matter in common with, and is a continuation-in-part of Ser. No. 08/038,226 filed Mar. 29, 1993 now abandoned, entitled SHOE CONSTRUCTION.

BACKGROUND OF THE INVENTION

This invention is concerned with an assembly of heel and outsole for a shoe construction having a molded outsole and shank for locking a heel into position and concurrently permitting styling the shoe.

In a slipper shoe construction embodying a heel there is a conventional construction in which a tuck board is employed together with a metallic insert to provide the connection between the heel and shank. It has been considered necessary to employ the metallic insert to provide the necessary strength in the shank. The presence of a cardboard tuck board is a further reason to employ a metallic insert in the shank.

The present invention avoids the conventional tuck board and metallic insert and introduces a laminated plastic shank that carries the support in the shank from the outsole forepart to the body of the heel. Such a deviation accomplishes a construction that is strong, light weight, permits a basis for styling the appearance of the shank, and maintains the necessary security of the heel attachment so the shoe holds its shape to maintain appearance.

It is a further unique character of the shoe construction that the shank can feature a design appearance as to either color or surface design in view of the molded plastic shank material that is integrated with the forepart of the outsole, and the provision for a portion of a cushion in the heel to be visible in an aperture at the breast of the heel where the shank terminates so as to complement the shank.

An important feature is to eliminate metallic arch supports and rely on the application of plastic material to make a reduction in the weight of the shoe without prejudice to the stability of the heel relative to the upper.

A further unique characteristic of the shoe construction is the ability to incorporate cushion means in the heel to greatly improve the comfort and fit of the shoe; and also to obtain an improvement in the flexibility of the forepart of the outsole.

Other features of the construction of the shoe will be set forth in the following description, having reference to the several drawing views.

BRIEF DESCRIPTION OF THE DRAWINGS

The drawings illustrate a preferred embodiment of the shoe construction, wherein.

DETAIL DESCRIPTION OF THE EMBODIMENT

Figure 1:
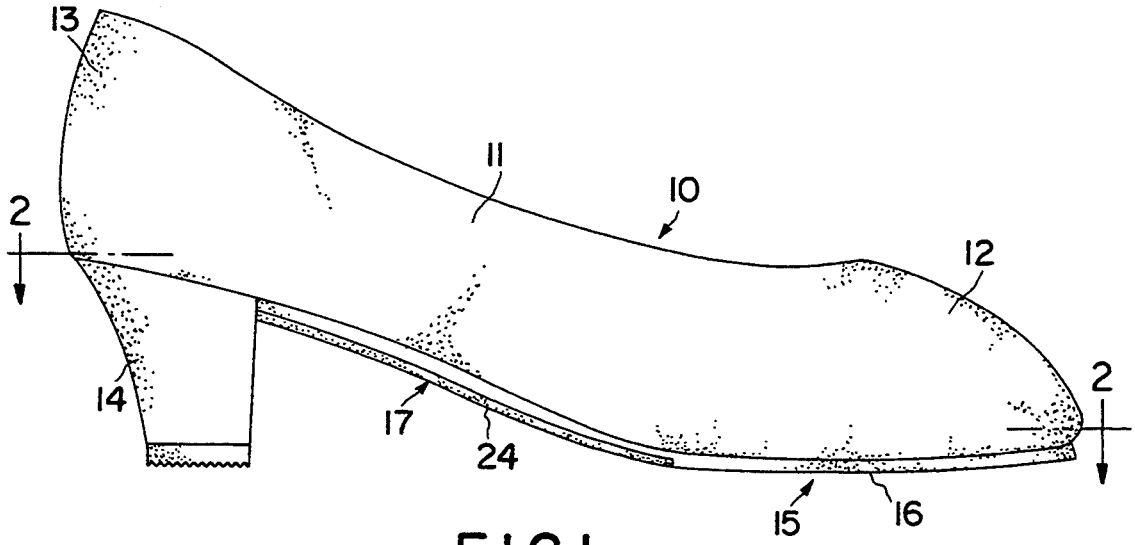
FIG. 1 is a side elevation of a style of shoe possessing the structural characteristics to be seen in the following views.
Figure 3:
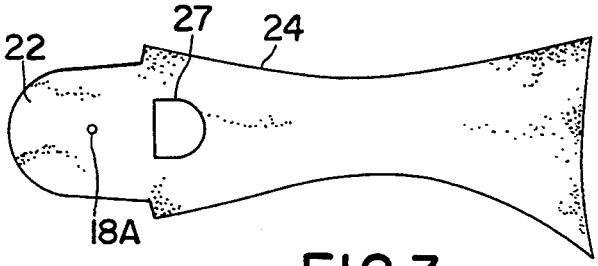
FIG. 3 is a fragmentary plan view of the external ply for the shank.
Figure 4:
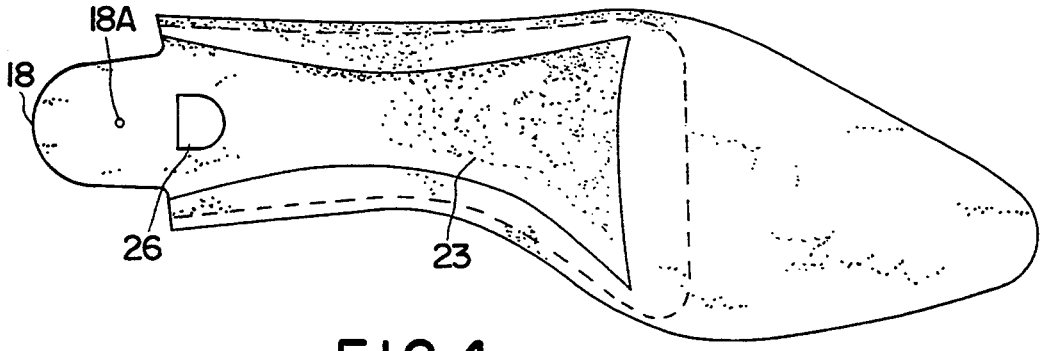
FIG. 4 is a fragmentary plan view of the outsole showing the heel and shank which is embedded by molding into the outsole.

The completed shoe 10 of FIG. 1 shows a typical shoe assembly 11 formed with a toe cap 12 enclosing the forepart, a heel structure 13 at the opposite end formed with an opening 13A, the body of a heel. 14, and an outsole 15 divided into a forepart 16 and a shank or instep 17. The shoe is open to receive a foot with the toes fitting under the cap 12.

Figure 2:
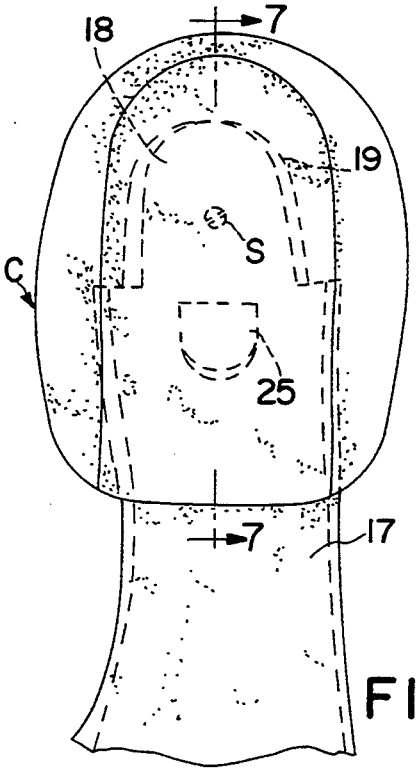
FIG. 2 is a fragmentary plan view looking into the heel area of the shoe to show the assembly of components making up the assembly of the components in the area of the heel, the view being taken at line 2—2 in FIG. 1.
Figure 5:
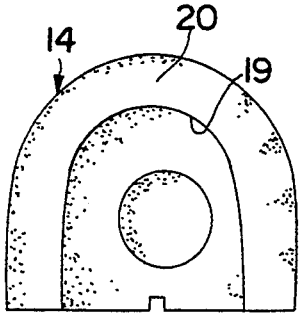
FIG. 5 is a plan view of the top surface of the heel showing the recessed area to receive the attachment end for the molded shank plies to be attached to the shoe heel.
Figure 7:
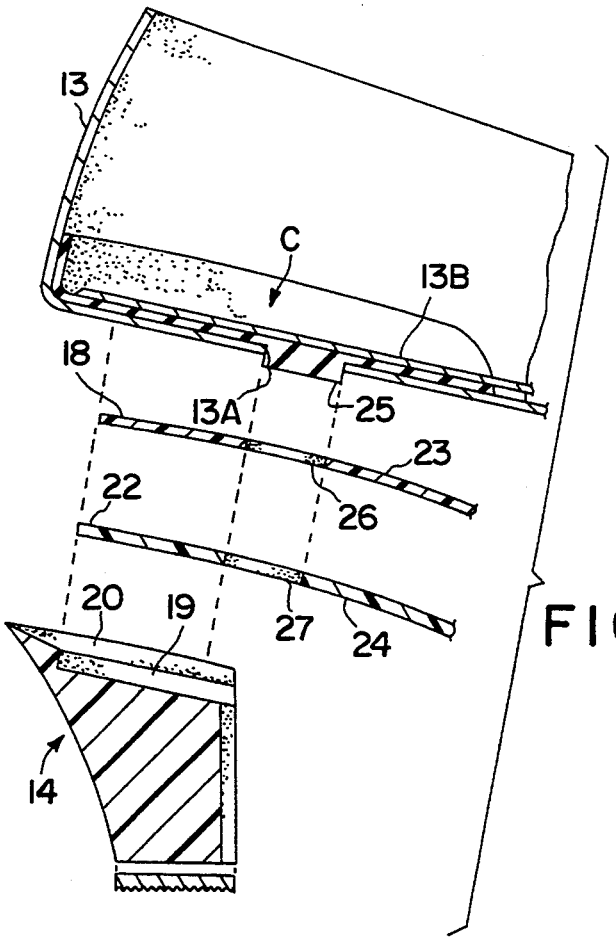
FIG. 7 is an exploded and fragmentary sectional view of the heel assembly.
Figure 10:
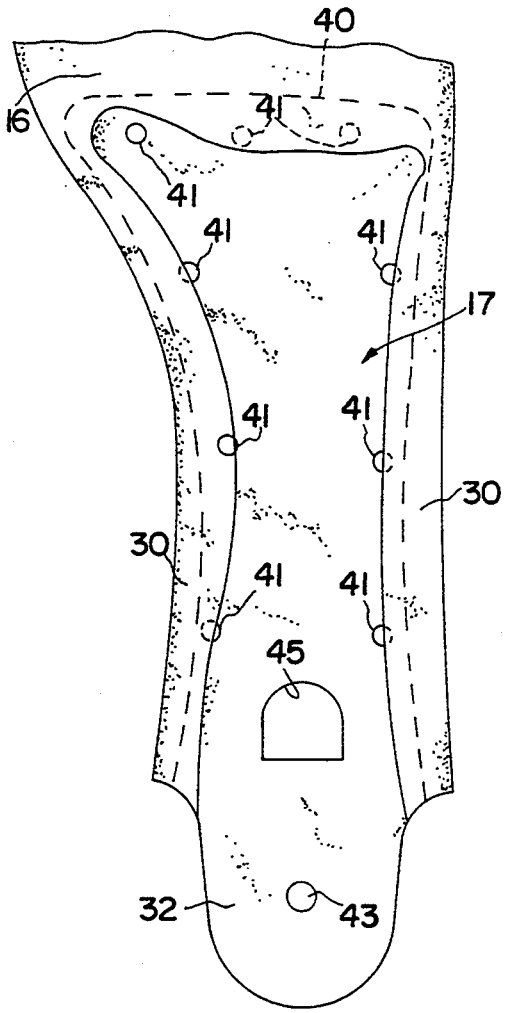
FIG. 10 is a view from the upper side of the shank molded into the outsole and anchored by mechanical interlock openings.

The views; of FIGS. 2 and 5 show the internal plan view of the heel area of the shoe 10 in which the shank 17 has a tab means 18 thereon (in dotted outline) which extends into a reception socket 19 of the heel body seen in FIG. 5 to be facing upwardly toward the shoe upper which overlies the heel beneath a flexible heel cup C carrying a cushion 25. As is indicated in a dotted outline there is seen in FIG. 2 the formation of tab 18 which overlies the position of the heel and the tab means is sized to seat in the reception socket 19 in the seat surface 20 (FIG. 5) of the heel 14. In FIG. 7 it is seen that the heel 13 of the upper receives a cup C having on its underside a cushion 25 which is positioned to seat in the apertures 26 and 27 of the shank tabs 18 and 22. That cushion assumes a position in assembly with a portion exposed to become visible when the components of the shoe are assembled. The visible exposure of the cushion serves as an indication of the style of the shoe 10, and can be color coded for that purpose. In addition an insole ply 13B is disposed to lie over the cup C. Since the tabs are aligned a single screw hole 18A receives a suitable screw the head of which is seen in phantom in FIG. 2 at S. That screw S is located by being applied from the inside of the shoe upper 11 that seats down on the heel seat 20 and secures the tabs of shank ply 23 and ply 24 to the heel 14.

The composite view of FIG. 7 illustrates the components of the cushion heel assembly 13 which establish a locking connection between the socket 19 in the seat surface 20 of the heel 14 and the heel tabs 18 and 22 of the two plies of outsole shank 17. The shank 17 of the shoe 10 has two plies 23 and 24 molded together so that the plies have a common tab, seen separately at 18 and 22. In order to strengthen the locking connection, the moldable material constituting the shank 17 may be selected from a composite of Fiberglas filaments combined in a graphite mat producing a surface sheen appearance, while the outsole forepart 16 is constituted of a polyurethane foam or resin or polyvinyl chloride in the form of a commercial vinyl resin having properties useful in shoes which vary with the method of polymerization. It is also contemplated that the outsole forepart 16 may employ polyurethane rubber for good abrasion resistance and temperature stability. The shank 17 of the shoe is formed with the outermost ply 24 adhesively or otherwise suitably secured as a unitary member to the ply 23. The plies 23 and 24 have been molded together to form the shank 17 of the outsole 15 which adds rigidity, light weight and stability in the shank 17 of the shoe 10 so the reaction of the heel 14 to the walking weight will maintain its position.

Figure 8:
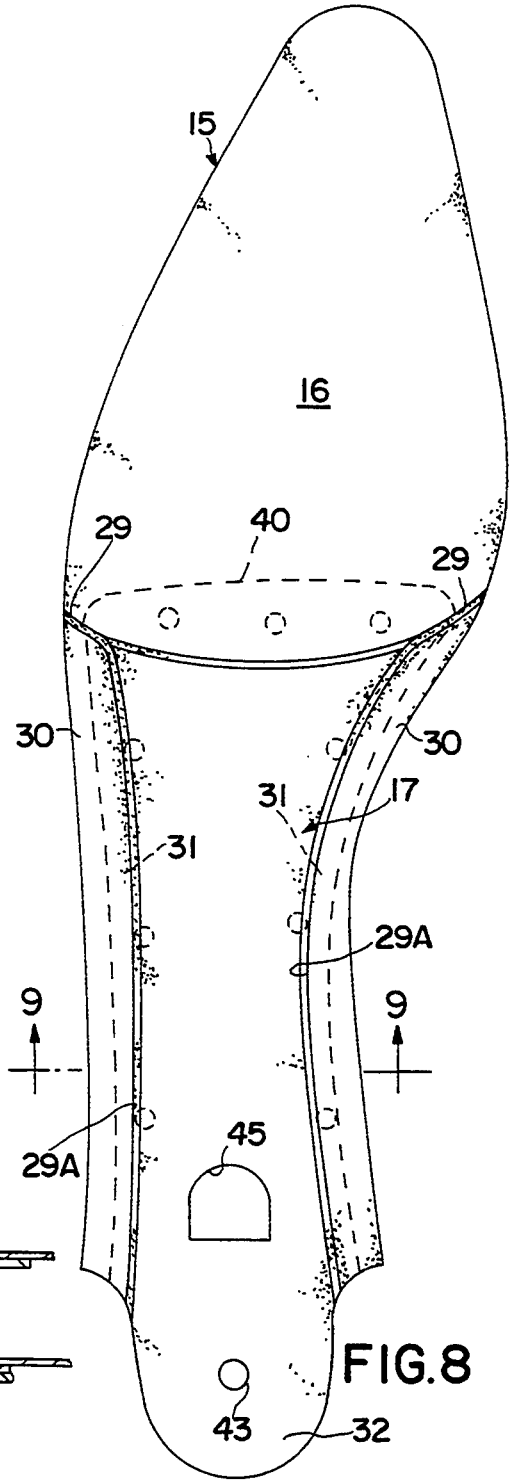
FIG. 8 is an enlarged plan view as seen from the street side of a molded composite one-piece outsole and shank to illustrate the incorporation of a thin but stiff shank.

The view of FIG. 8 drawn to a larger scale illustrates that the outsole 15 has identified the forepart 16 shape along grooves 29 for flexibility of the side extensions 30 which are molded onto the side margins 31 of the shank 17 to form the outsole 16 and side extensions 30 into a one-piece member including the shank 17 which extends into a tab 32 for connection to the socket 33 in the seat 34 of a heel 35. It appears in the FIG. 8 view that the outsole material 16 and the shank material 17 are connected in longitudinal elongation across the groove 29. The shank 17 has an outer ply 24 that is narrower relative to the wider inner ply 23, and these plies are aligned so that the margins 38 of the inner ply 23 are exposed at 39 to receive the outsole material 30 which covers the margins 38. The outsole is molded polyvinylchloride material which is soft and flexible.

Figure 9:
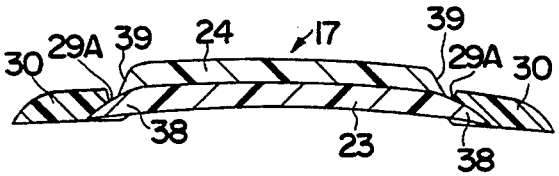
FIG. 9 is an enlarged section view along line 9—9 in FIG. 8.

The view of FIG. 9 illustrates how the shank 17 is a composite of adhesively secured outer ply 24 to the under ply 23. The under ply 23 has margins 38 which extend beyond the margins 39 of the outer ply 24 thereby forming dams or raised surfaces along the opposite margins for finishing the margins of the extensions 30 resulting in the formation of grooves 29A which continue from the transverse groove 29 into the heel tab 32. It is shown in FIG. 8 that the forward end 40 of the shank ply 17 is embedded in the material of forepart 16 beyond the transverse groove 29 to carry the support for the ball of the foot into the outsole forepart. This construction provides stability to the shoe and has the advantage of being light weight due to no metallic parts.

In order to obtain a secure mechanical or engineered lock type connection the imbedded margins 31 of the shank 17 with the outsole 15, the margins 31 have spaced apertures 41 spaced along so that when the material of the outsole is introduced to the mold cavity it will enter the apertures and make a permanent interlock between the shank 17 and the outsole 15.

The foregoing components are attached (see FIG. 11) to a shoe heel 35 at the socket 33 by a single screw 42 which is insertable from the inside of the upper 10 in the opening 43 in the tab 32 and is threaded into the heel 35 to establish a secure attachment along with adhesive applied on the contacting surfaces. A heel cup C is then applied in the interior of the shoe upper 10 so that the head of the screw is covered. In addition there is a cushion pad 44 on the underside of the heel cup, which pad fits into a reception opening 45 in the shank 17. The cushion rests partly at the top of the heel breast and extends outwardly to be visible from the bottom of the shoe when it is turned over to inspect the shank. The interior of the shoe is provided with an insole 46 of suitable fiber material which is adhesively attached to the shank and lasted to the upper in the forepart and toe. The lasting is not shown. A sock lining 47 of suitable leather or plastic material covers a cushion member 48 on its under surface to assure the comfort to the foot and at the same time hold the cushion in desired position under the foot. If desired, the cup C and its cushion pad 44 may be colored to match the color of the upper 10. Color can be dictated by the customers dress appearance.

Figure 6:
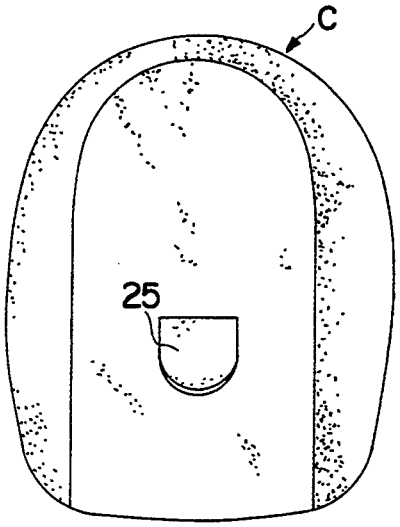
FIG. 6 is a view of the underside of the heel cup seen in FIG. 2.

Having established the locking connection between the socket 19 of the heel seat 20 and the tabs 18 and 22 of the multiply ply shank 17 of FIG. 7, a suitable cushion 25 seen in FIG. 6 is provided on the underside of the heel cup C seen in FIG. 7. The cushion 25 is formed of a size to match an aperture 26 in the heel tab 18 and a similar aperture 27 in the tab 22. The apertures 26 and 27 firmly locate the cushion pad 25 in the heel area of the shoe so there will not be any dislocation of the cushion 25 or the cup C during the life of the shoe.

Figure 11:
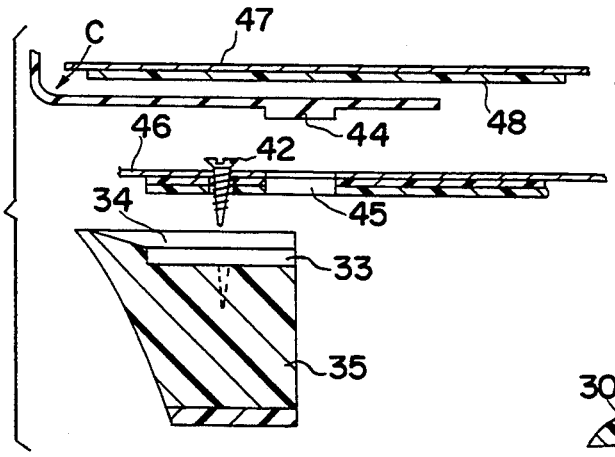
FIG. 11 is an exploded section view of the heel cup and tab attachment to the seat in the heel of the shoe.

In the view of FIG. 11, the outsole shank 17 is formed with the same two plies 23 and 24. However, in the molding process, the plies are molded into the material ply of the outsole 15. At that time the tab 32 is formed with the opening 43 to establish the means for locating the cushion 44 in the heel cup C. By positioning the tabs 32 in laminated contact, it is assured that the cushion 44 will be carried in the heel cup 33 at a place where the most effective cushioning of the wearer's heel will be obtained.

The foregoing shoe construction is unique in that there is established a secure and direct connection between an outsole shank and a heel so that the structural integrity of the shoe is maintained. Furthermore, the means for effecting a secure connection provides anchorage for the positioning of cushion means is obtained wherein tab projections on the laminated shank of the outsole are formed with cooperating openings 45 relatively exposed therebetween to establish the retention of cushion means in the heel seat area of the shoe.

It is not intended in the foregoing disclosure to limit the choice of moldable materials for the shoe outsole shank. What is desired is to achieve a positive connection between shank and heel with material that has the ability to maintain dimension characteristics over a long period of use and provide comfort through cushioning provisions at the same time.

What is claimed is:

1. A shoe construction having an outsole and a shank extension, and a surface for a heel adjacent the shank, the shoe structure comprising:

a) a shoe upper having a toe end and a substantially flat seat surface end present to said outsole, shank and surface for a heel, said heel surface having an aperture therein open to the exterior of said upper;

b) a heel formed with a seat surface substantially matching said upper seat surface, said heel seat surface being sized to leave open a portion of said aperture and formed with a socket;

c) tab means on said shank extending into said heel seat surface socket, said tab means having an opening registering with said aperture;

d) attachment means securing said upper and said tab means to said heel to retain said heel with said portion of said aperture open to view; and e) means in said upper fitted to cover said attachment means and having a portion thereof exposed in said aperture for view from the exterior of the shoe.

2. The shoe construction set forth in claim 1 wherein said attachment means retaining said tab means in said heel socket is a threaded element inserted in said heel seat surface and penetrating said shank tab means and retaining said shank tab means in said heel socket.

3. The shoe construction set forth in claim 1 wherein said means in said upper includes a cushion element fitted in position to be exposed in said aperture in said upper.

4. The shoe construction set forth in claim 3 wherein said means in said upper is a heel receiving cup having said cushion element carried thereby.

5. The shoe construction set forth in claim 1 wherein a heel receiving cup is fitted in said upper over said aperture therein, and cushion means on said cup is disposed in said aperture to be visible from the exterior and said cushion means acts to retain said cup in heel receiving position.

6. In a shoe construction having a foot receiving upper formed with a toe receiving end and an opposite heel receiving end, the combination comprising:

a) a heel having a surface adapted to receive the heel receiving end of the upper, and said surface having a recessed socket;

b) outsole material and shank material connected in longitudinal molded elongation, said shank having an inner wide ply and an outer narrow ply aligned such that the inner wide ply has longitudinal margins expanding on each side of said outer narrow ply molded into said outsole material, and said inner and outer shank plies having extensions shaped to fit into said heel recessed socket and said shank plies being formed with an aperture exposing a portion of said heel receiving socket;

c) an insole in the upper to extend into the heel receiving end and having an aperture aligned with said aperture in said shank plies;

d) securing means penetrating said insole and heel surface to secure the upper to said heel; and e) a heel receiving cup disposed in the upper to conceal said securing means and close said aligned apertures, said cup supporting cushion means fitted into said aligned apertures, a portion at least of said cushion means being rendered visible from said shank.

7. The combination set forth in claim 6 wherein said outsole and said shank are flexible in bending in the molded connection thereof.

8. The combination set forth in claim 6 wherein said shank material is molded from a composition of glass filiments combined in a graphite mat producing a surface sheen visual appearance, and said outsole material is a commercial vinyl resin.

9. The combination set forth in claim 6 wherein said shank material plies are secured by molding as a unitary member to supply rigidity, light weight and stability to the shoe construction.

10. The combination set forth in claim 6 wherein said outsole material is soft and flexible polyvinyl chloride.

11. The combination set forth in claim 6 where a sock lining overlies said heel receiving cup for securing said cup in position, and cushion means is positioned under said sock lining.

12. The combination set forth in claim 6 wherein a strong connection is provided between said outsole and heel through said shank.

* * * * *